US009828122B2

(12) United States Patent
Navarro Rosales et al.

(10) Patent No.: US 9,828,122 B2
(45) Date of Patent: Nov. 28, 2017

(54) CONTAINER FILLING APPARATUS

(75) Inventors: Miguel Angel Navarro Rosales, Estado de Mexico (MX); Yoshifumi Morita, Estado de Mexico (MX)

(73) Assignee: NISSIN FOODS HOLDINGS CO., LTD., Osaka (JP)

( * ) Notice: Subject to any disclaimer, the term of this patent is extended or adjusted under 35 U.S.C. 154(b) by 495 days.

(21) Appl. No.: 14/382,661

(22) PCT Filed: Mar. 15, 2012

(86) PCT No.: PCT/JP2012/001832

§ 371 (c)(1),
(2), (4) Date: Sep. 3, 2014

(87) PCT Pub. No.: WO2013/136370

PCT Pub. Date: Sep. 19, 2013

(65) Prior Publication Data

US 2015/0027084 A1 Jan. 29, 2015

(51) Int. Cl.
*B65B 43/50* (2006.01)
*B65B 5/04* (2006.01)
(Continued)

(52) U.S. Cl.
CPC ..... *B65B 5/04* (2013.01); *B65B 23/00* (2013.01); *B65B 43/46* (2013.01)

(58) Field of Classification Search
CPC ..... B65B 43/42; B65B 43/46; B65B 43/48; B65B 43/50
(Continued)

(56) References Cited

U.S. PATENT DOCUMENTS 3,892,874 A * 7/1975 Ando ..... A23L 7/111 426/303
4,166,139 A * 8/1979 Ishida ..... A21B 5/08 426/115
(Continued)

FOREIGN PATENT DOCUMENTS

CN 201849673 6/2011
JP 4-311409 11/1992
(Continued)

OTHER PUBLICATIONS

Search report from International Patent Appl. No. PCT/JP2012/001832, dated May 22, 2012.
(Continued)

*Primary Examiner* — Gloria R Weeks
(74) *Attorney, Agent, or Firm* — Greenblum & Bernstein, P.L.C.

(57) ABSTRACT

A container filling apparatus of the present invention includes: a first supply apparatus configured to supply a content; a rotational body having a placement portion configured to carry the contents supplied by the first supply apparatus, the rotational body being configured to rotate with respect to an axis thereof to turn the placement portion; a second supply apparatus configured to place a container from above on the content placed in an upward-facing state on the placement portion; and an engagement portion provided on the rotational body and configured to engage with the container that is placed over the content by the second supply apparatus, wherein the container is disengageable from the engagement portion by the container being rotated by the rotational body at an angle.

5 Claims, 11 Drawing Sheets

(51) Int. Cl.
*B65B 43/46* (2006.01)
*B65B 23/00* (2006.01)

(58) Field of Classification Search
USPC ..... 53/249, 251, 253
See application file for complete search history.

(56) References Cited

U.S. PATENT DOCUMENTS 4,802,324 A * 2/1989 Everson ..... B65B 43/265 53/251
5,230,201 A * 7/1993 Iuchi ..... B65B 43/52 198/482.1
5,419,240 A * 5/1995 Morishita ..... A23L 7/111 426/439
5,588,282 A * 12/1996 Hartness ..... B65B 21/183 53/248
6,571,532 B1 * 6/2003 Wiernicki ..... B65B 21/183 414/225.01
2013/0160659 A1 * 6/2013 Okazawa ..... A21C 11/22 99/536

FOREIGN PATENT DOCUMENTS

| | | |
|---|---|---|
| JP | 6-50321 | 2/1994 |
| JP | 7-61410 | 3/1995 |
| JP | 2005-162413 | 6/2005 |
| JP | 2006-131255 | 5/2006 |
| JP | 2009-90990 | 4/2009 |

OTHER PUBLICATIONS

Office Action issued in Chineset Patent Appl. No. 201280071288.0, dated Nov. 27, 2015 , along with an english translation thereof.

* cited by examiner

[Fig. 1]
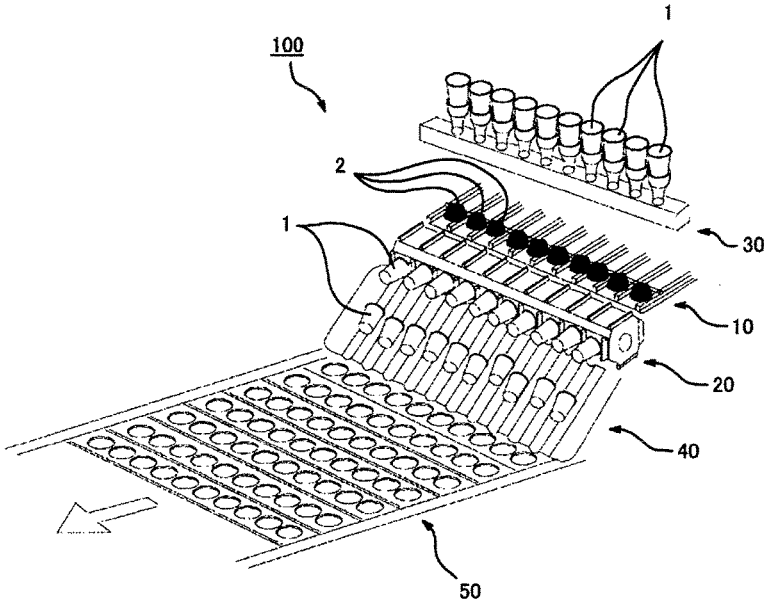

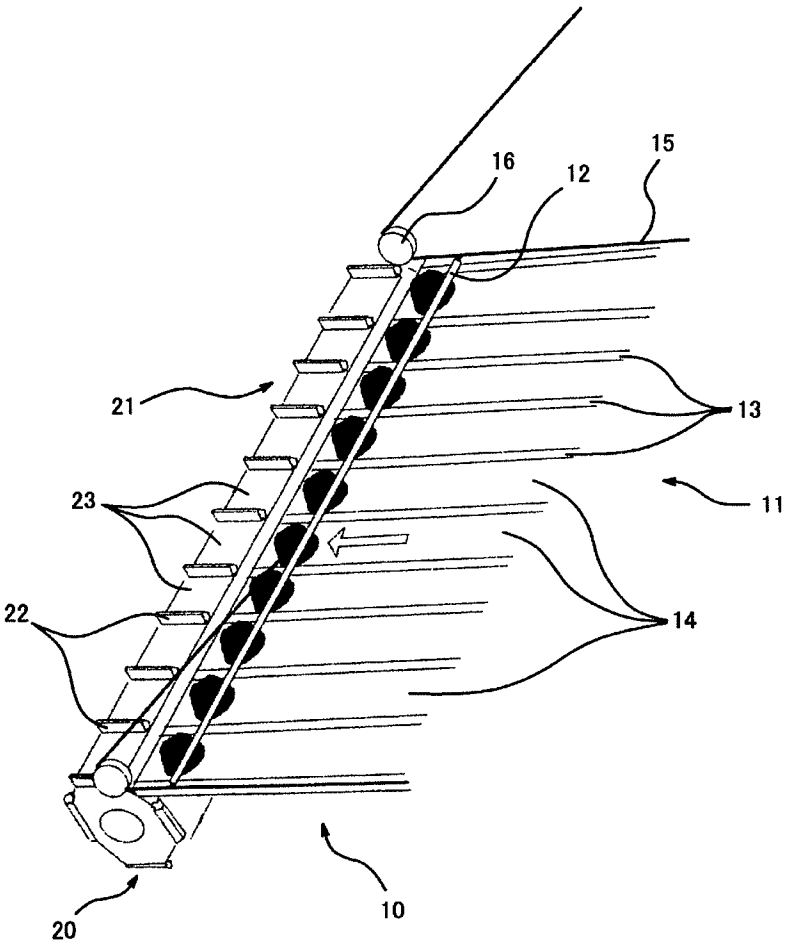
[Fig. 2]

[Fig. 3]
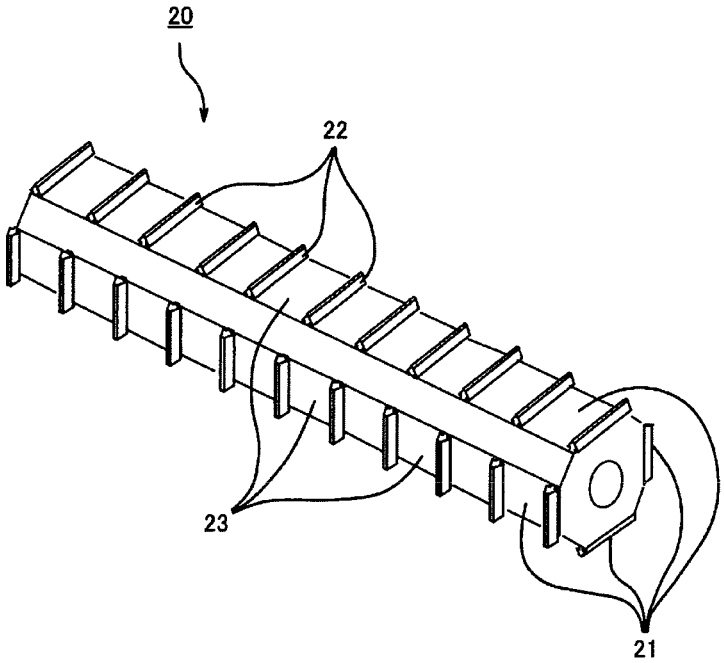
[Fig. 4]
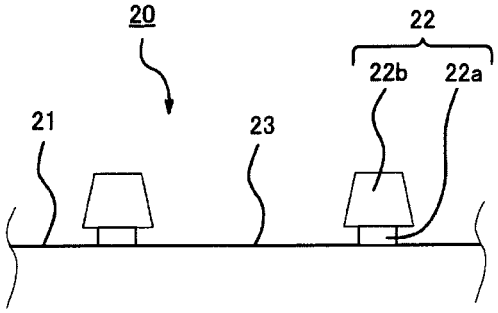

[Fig. 5]
(a)
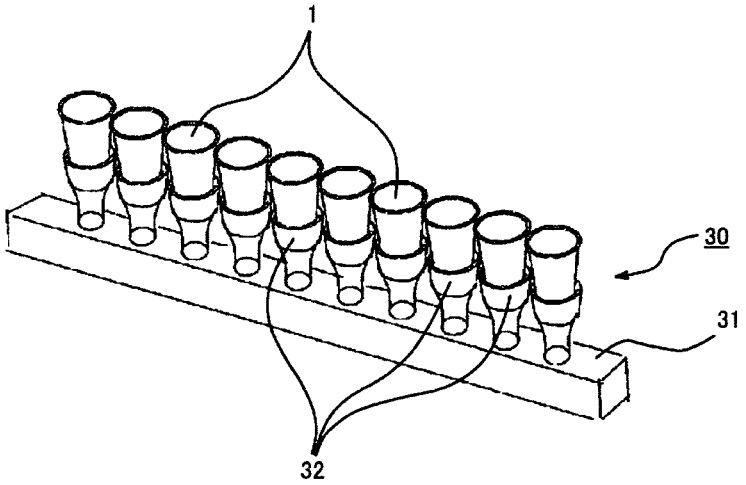
(b)
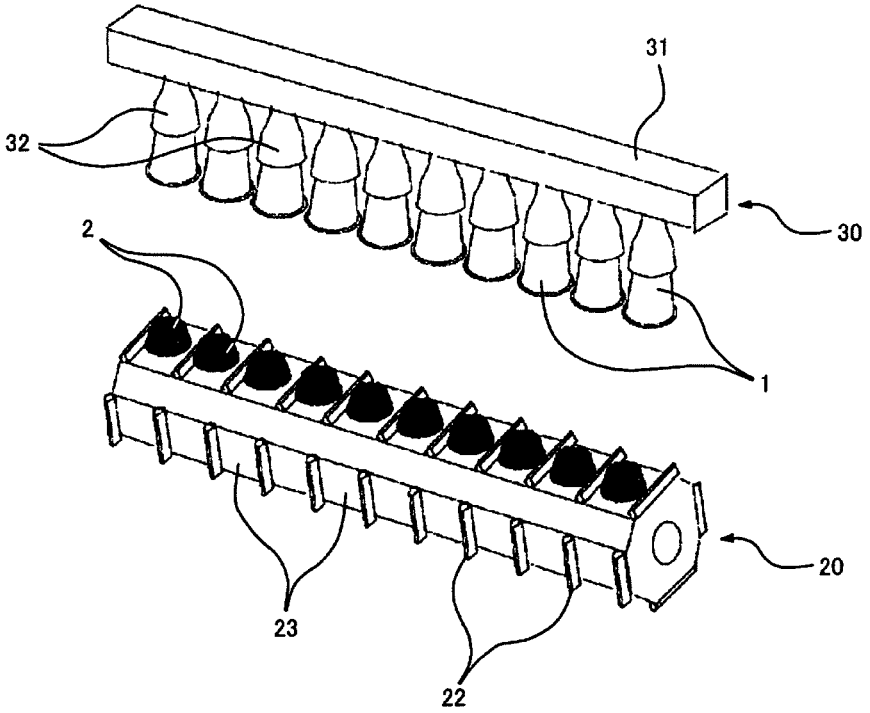

[Fig. 6]
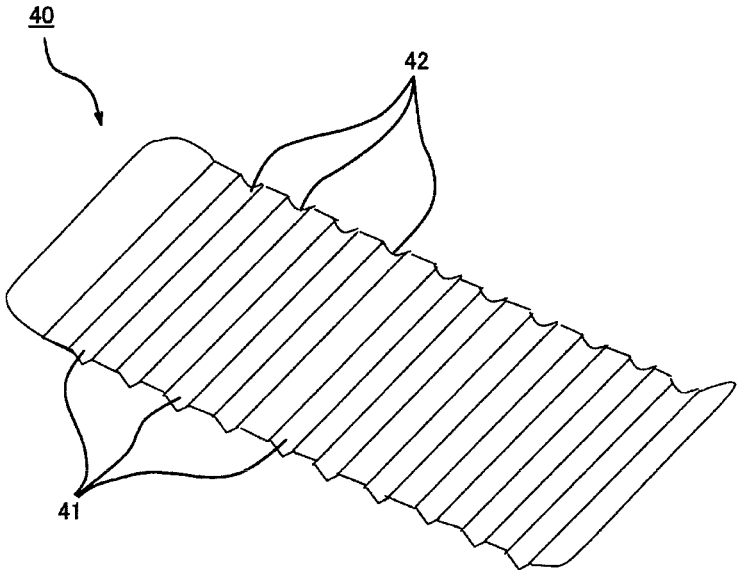

[Fig. 7]
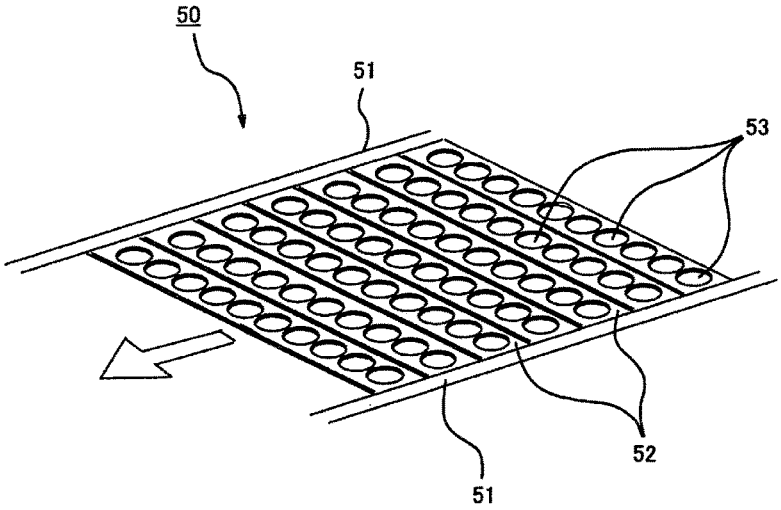
[Fig. 8]
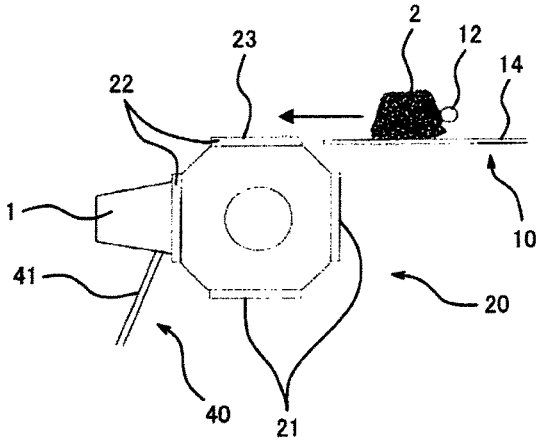

[Fig. 9]
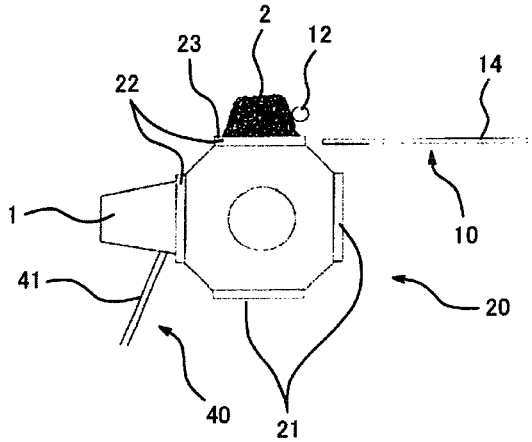
[Fig. 10]
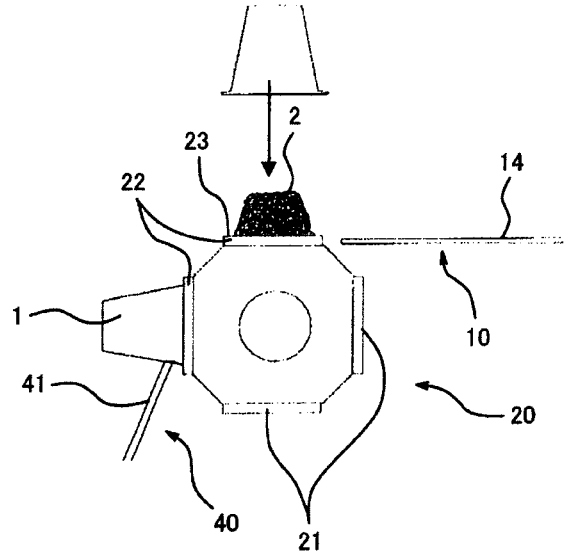

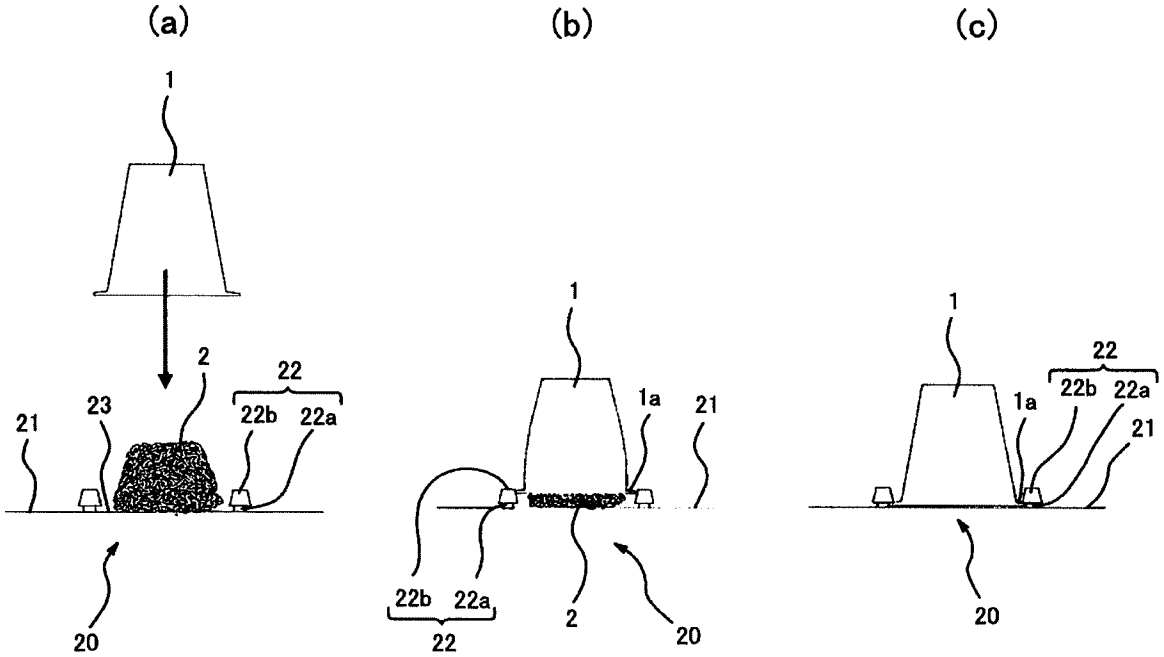
[Fig. 11]

[Fig. 12]
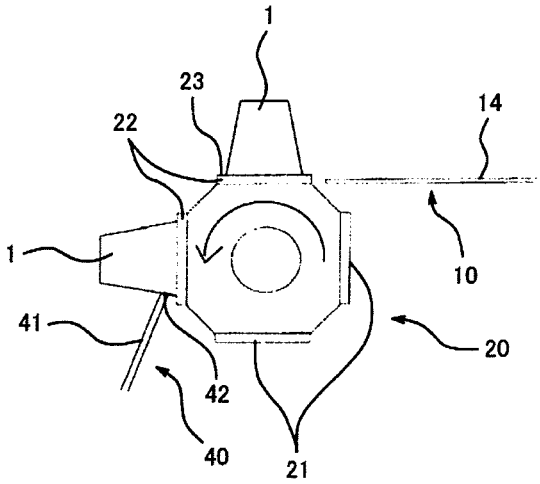
[Fig. 13]
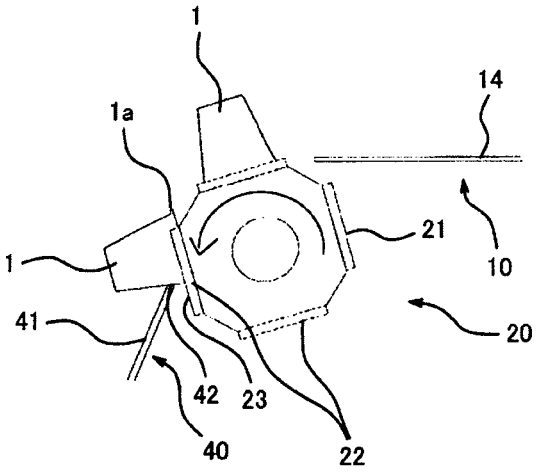

[Fig. 14]
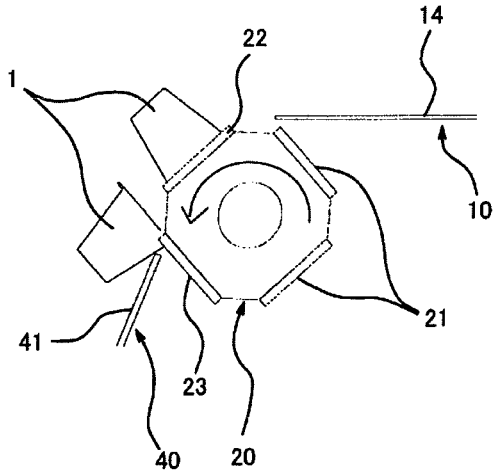
[Fig. 15]
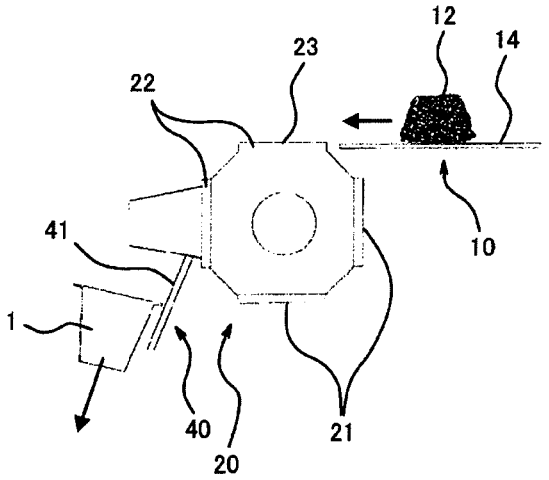

[Fig. 16]
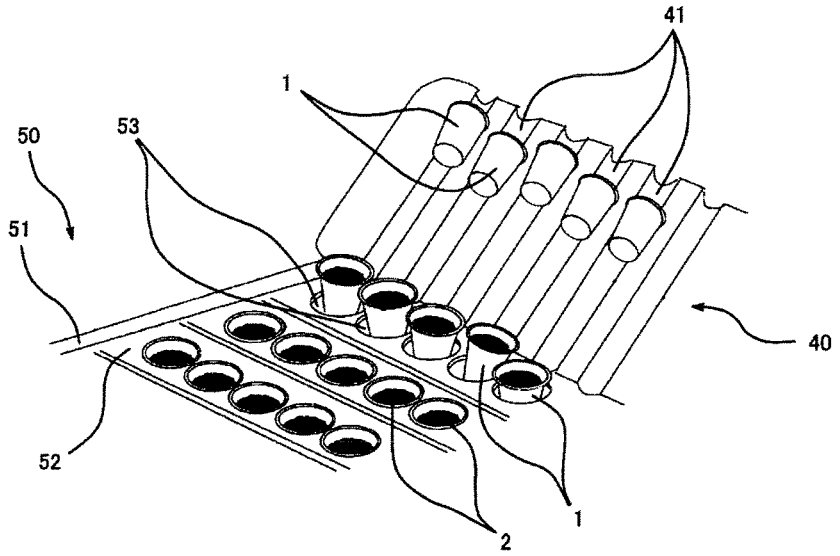

CONTAINER FILLING APPARATUS

TECHNICAL FIELD

The present invention relates to container filling apparatuses, and more specifically, to apparatuses configured to fill containers with fragile contents.

BACKGROUND ART

A filling apparatus has been known which is operative to place a container from above on a content and reverse the container by 180 degrees so as to protect a fragile content, such as a noodle lump, from breakage. After the content is filled in the container in such a filling apparatus, the container is transferred to a conveying apparatus from the filling apparatus.

For example, in reversing the container filled with the content, the container is held by, for example, an arm from the periphery of the container so as to prevent the container from falling. When the container arrives on the conveying apparatus, the arm releases the container. Thus, the container falls from the filling apparatus to the conveying apparatus and is received and conveyed by the conveying apparatus (for example, see PTLs 1 to 3).

CITATIONS LIST

Patent Literatures

PTL 1: JP-A-04-311409
PTL 2: JU-B-06-050321
PTL 3: JP-A-2006-131255

SUMMARY OF INVENTION

Technical Problem

Such prior art however involves a control system for operating the arm. For this reason, the filling apparatus has a complex structure and a large size.

The present invention has been made in view of the foregoing circumstances and is to provide a container filling apparatus that has a simpler structure and a smaller size.

Solution to Problem

A container filling apparatus according to an aspect of the present invention includes: a first supply apparatus configured to supply a content; a rotational body having a placement portion configured to carry the content supplied by the first supply apparatus, the rotational body being configured to rotate with respect to an axis thereof to turn the placement portion; a second supply apparatus configured to place a container from above on the content placed in an upward-facing state on the placement portion; and an engagement portion provided on the rotational body and configured to engage with the container that is placed over the content by the second supply apparatus. Herein, the container is disengageable from the engagement portion by the container being rotated by the rotational body at an angle.

With this configuration, the rotational body rotates around the axis, and the orientation of the placement portion changes. When the placement portion becomes horizontal and faces upward, a content is placed on the placement portion by the first supply apparatus. Further, a container is placed by the second supply apparatus from above on the content placed on the placement portion. At this time, the container is rotated by the rotational body with the container engaged with the engagement portion. Thus, the orientation of the container is changeable while the container is prevented from falling at the time of rotation. Then, the container is released from the engagement portion by the container being rotated at a certain angle.

In this manner, the engagement portion is not used for operation, for the engagement portion does not actuate in engagement and this release. Thus, the container filling apparatus has a simpler structure and a smaller size.

The container filling apparatus may further include: a slider having a downward-slanting groove configured to let the container disengaged from the engagement portion slide off; and a conveying apparatus having a receiving portion configured to receive the container slid off from the groove.

With this configuration, when the container is disengaged from the engagement portion, the container leaves from the placement portion of the rotational body. At this time, since the container is rotated by the rotational body and the content is moved to the bottom side of the container, the bottom side of the container is heavier. Hence, the container that has left from the placement portion inclines such that the bottom comes lower, and slips down along the downward-slanting groove. Then, the container is received from the bottom in the receiving portion to be conveyed to the subsequent process by the conveying apparatus.

In the container filling apparatus, a plurality of engagement portions identical to the engagement portion may be provided in a direction of the axis of the rotational body, and the placement portion may be arranged in between the plurality of engagement portions.

With this configuration, the container is engaged with the engagement portions of the rotational body in the axial direction. Thus, the container is attached to the rotational body in such a state as to be movable in a direction perpendicular to the axial direction, i.e., the direction of rotation. Hence, when the rotational body rotates by a certain angle, the container is moved in the direction of rotation with respect to the placement portion, and the container is easily released from the engagement portions.

The container filling apparatus may further include a receptacle configured to receive a stem portion of the container. Herein, the container received by the receptacle is disengageable from the engagement portion.

With this configuration, when the rotational body rotates with the container placed on the placement portion, the placement portion is moved in the direction of rotation. However, when the container hits the receptacle, the stem portion of the container is supported and stopped by the receptacle. Since this container is movable in the direction of rotation, the container is displaced with respect to the placement portion and the engagement portion, such that the container is easily disengaged from the engagement portion.

In the container filling apparatus, the rotational body may have four placement portions identical to the placement portion in a direction of the rotation, and the receptacle may be configured to receive the stem portion of the container that is rotated by the rotational body at 90 degrees.

With this configuration, the four placement portions of the rotational body are each supplied with the contents and the containers. Hence, while the rotational body rotates one time, the filling process is continuously performed four times, thus allowing for improvement in processing efficiency.

In addition, when the container is rotated by 90 degrees by the rotational body, the opening of the container is oriented in the vertical direction. When the stem portion of the container is supported by the receptacle in this state, the opening faces upward while the rotating placement portion as the container is being displaced relative to the placement portion. Then, when the container is released from the engagement portion, the container smoothly slides off along the groove in the slider with the bottom at the lower side.

Advantageous Effects of Invention

The present invention has the above-described configuration and effectively provides a container filling apparatus with a simpler structure and a smaller size.

The above object, other objects, features, and advantages of the present invention will become apparent from the following detailed description of preferred embodiments with reference to the accompanying drawings.

BRIEF DESCRIPTION OF DRAWINGS

FIG. 1 is a perspective view depicting the schema of a container filling apparatus according to a first embodiment of the present invention.

FIG. 2 is a perspective view depicting a first supply apparatus for use in the container filling apparatus of FIG. 1.

FIG. 3 is a perspective view depicting a rotational shaft for use in the container filling apparatus of FIG. 1.

FIG. 4 is an enlarged side view depicting a portion of the rotational shaft of FIG. 3.

FIG. 5 is a perspective view depicting a second supply apparatus for use in the container filling apparatus of FIG. 1.

FIG. 6 is a perspective view depicting a slider for use in the container filling apparatus of FIG. 1.

FIG. 7 is a perspective view depicting a conveying apparatus for use in the container filling apparatus of FIG. 1.

FIG. 8 is an explanatory view of a state in which a content is fed by the first supply apparatus in the container filling apparatus of FIG. 1.

FIG. 9 is an explanatory view of a state in which the content is moved onto the rotational shaft in the container filling apparatus of FIG. 1.

FIG. 10 is an explanatory view of a state in which a container is placed over the content on the rotational shaft in the container filling apparatus of FIG. 1.

FIG. 11 is an explanatory view of a state in which a flange of the container is engaged with an engagement portion of the rotational shaft in the container filling apparatus of FIG. 1.

FIG. 12 is an explanatory view of a state in which the rotational shaft with the container placed thereon is being rotated in the container filling apparatus of FIG. 1.

FIG. 13 is an explanatory view of a state in which the rotational shaft with the container placed thereon is being rotated in the container filling apparatus of FIG. 1.

FIG. 14 is an explanatory view of a state in which the container is moving along the slider in the container filling apparatus of FIG. 1.

FIG. 15 is an explanatory view of a state in which the container is moving along the slider in the container filling apparatus of FIG. 1.

FIG. 16 is an explanatory view of a state in which the container is contained in a conveying plate of the conveying apparatus in the container filling apparatus of FIG. 1.

DESCRIPTION OF EMBODIMENTS

Embodiments of the present invention are described below with reference to the drawings.

In the following description, like or corresponding components are given like reference numerals throughout the drawings and a redundant description is not given.

FIG. 1 is a perspective view of the schema of a container filling apparatus 100. For concise description, for example, a shaft and a sprocket of a rotational body 20 and a motor serving as a power source of a first supply apparatus 10 are not depicted in the drawings.

In the following description, for convenience sake, the direction parallel to the rotation axis of the rotational body 20 is referred to as an "axial direction." The direction that is perpendicular to the axial direction and in which contents 2 are transported as indicated by the arrow in FIG. 1 is referred to as a "transport direction." The direction in which the contents 2 are delivered is referred to as "downstream," and the direction opposite the downstream side is referred to as "upstream".

The container filling apparatus 100 is configured to fill containers 1 with the contents 2.

The container 1 has a truncated conical shape, so-called a cup shape, that is open at the top side. The diameter of the opening edge of the container 1 is set larger than the diameter of the bottom surface. A flange is provided around the opening edge of the container 1 so as to project outward along the entire outer periphery.

The content 2 is a solid substance such as a noodle lump. The noodle lump is produced by drying a lump of noodles by using an oil heat or a hot blast and has a certain shape. The noodle lump may be of any size insofar as the lump is contained in the container 1.

FIG. 2 is a perspective view of the first supply apparatus 10 for use in the container filling apparatus 100.

The first supply apparatus 10 is configured to supply noodle lumps continuously onto the rotational body 20. For example, a conveyor with a feeding plate 11 and a feeding bar 12 is used for the first supply apparatus 10.

The feeding plate 11 is a flat plate and is disposed horizontally or is inclined. In the case where the feeding plate 11 is inclined, the feeding plate 11 tilts such that the downstream end is positioned lower than the upstream end. A plurality (ten in this embodiment) of feed paths 14 is provided on the feeding plate 11. The feed paths 14 are each arranged between adjacent two partitions 13. The feed paths 14 extend in the transport direction. The width of the feed paths 14 is set slightly larger than the width of the contents 2.

The feeding bar 12 is a rod-shaped member. The longitudinal direction of the feeding bar 12 is perpendicular to the feed paths 14, i.e., the axial direction. The length of the feeding bar 12 is set to be approximately the same as the width of the feeding plate 11. The feeding bar 12 may be provided by one or by more than one. In the case where a plurality of feeding bars 12 is provided, certain intervals are provided between each feeding bar 12. The feeding bar 12 is movable by being towed by a tower. The tower may include a string 15 for pulling the feeding bar 12, a roller 16 for changing the direction of the string 15, and a motor (not shown) for tugging the string 15.

FIG. 3 is a perspective view of the rotational body 20 for use in the container filling apparatus 100. FIG. 4 is an enlarged side view depicting a portion of the rotational body 20.

The rotational body 20 is a device configured to turn the contents 2 and the containers 1. For example, a polygonally (octagonally in this embodiment) faceted columnar body is used for the rotational body 20. The rotational body 20 includes a rotational shaft to serve as the center of rotation in the transport direction. The rotational shaft is provided with a shaft (not shown) for transmitting the torque to be provided by a rotation power source (not shown) to the rotational body 20. The rotational body 20 has a plurality (four in this embodiment) of placement areas 21. The placement areas are flat and are provided with intervals therebetween. As depicted in FIG. 2, the rotational body 20 is disposed such that the uppermost placement area 21 is at the same level as the feeding plate 11. The upstream end of the uppermost placement area 21 is positioned in parallel to and in the vicinity of the downstream end of the feeding plate 11. The dimension of a clearance between the upstream end of the placement area 21 and the downstream end of the feeding plate 11 is set smaller than the diameter of the contents 2 such that the contents 2 will not fall from the clearance.

A plurality (eleven in this embodiment) of engagement portions 22 is provided on each placement area 21. The engagement portions 22 are provided in the axial direction with intervals provided therebetween and extend in the transport direction over the entire extent from the upstream ends to the downstream ends of the placement areas 21. As depicted in FIG. 4, the engagement portions 22 are upright perpendicularly to the placement areas 21. Each engagement portion 22 includes a narrower portion and a wider portion that is disposed on the narrower portion. The width of the narrower portions is uniform. The distance between the adjacent two narrower portions is set slightly larger than the diameter of the flange of the container 1. The wider portions are inclined such that the width of the wider portions is increased toward the placement area 21. The distance between the two adjacent wider portions is set to be the same as or slightly larger than the diameter of the flange at the open edges of the wider portions. This distance is reduced toward the placement area 21. This distance is set at the lower ends of the wider portions so as to be smaller than the diameter of the flange and slightly larger than the diameter of the opening edge of the container 1. Thus, as described later (FIG. 11), the engagement portions 22 function as an engager for engaging with the flange of the container 1.

Placement portions 23 are provided between the engagement portions 22 and interpose between the two engagement portions 22 in the axial direction of the rotational body 20. The number of the placement portions 23 in one placement area 21 is the same as the number of the feed paths 14, and the ten placement portions 23 in this embodiment are provided in each placement area 21. The distance between and width of the placement portions 23 are set to be the same as the distance between and width of the feed paths 14 such that the placement portions 23 connect to the feed paths 14, respectively.

FIG. 5(*a*) is a perspective view depicting a second supply apparatus 30 for use in the container filling apparatus 100. FIG. 5(*b*) is a perspective view depicting the second supply apparatus 30 and the rotational body 20 having the contents 2 placed thereon.

The second supply apparatus 30 is positioned above the rotational body 20 and is configured to cover the upward-facing contents 2 placed on the placement portions 23 with the containers 1 from above. The second supply apparatus 30 has a base body 31, and a plurality (ten in this embodiment) of suction units 32 coupled on the upper surface of the base body. The orientation of the base body 31 is changed from the state in which the upper surface of the base body 31 is facing upward as depicted in FIG. 5(*a*) to the state in which the upper surface of the base body 31 faces down as depicted in FIG. 5(*b*). The base body 31 is also movable upward and downward, and the base body 31 is descendable until the downward-facing suction units 32 come to a position in the vicinity of the rotational body 20.

The suction units 32 are truncated conical and have a shape that allows the containers 1 to fit therein. The suction units 32 have suction apertures (not shown) therein. As depicted in FIG. 5(*b*), the suction units 32 are arranged so as to oppose the placement portions 23 when facing down.

FIG. 6 is a perspective view depicting a slider 40 for use in the container filling apparatus 100.

The slider 40 is a portion to receive the containers 1 turned by the rotational body 20 and let the containers 1 slide off. The slider 40 is flat. The upstream end of the slider 40 is located, for example, so as to be in parallel and proximate to the downstream end of a placement area 21 that extends along the horizontal direction and becomes vertical. The slider 40 is inclined such that the downstream end thereof is lower than the upstream end. The slider 40 has a plurality (ten in this embodiment) of grooves 41.

The grooves 41 are linear and slant downward, and extend over the entire extent from the upstream end to the downstream end of the slider 40. Setting the length of the grooves 41 larger than the length of the containers 1 allows the containers 1 to slide off along the grooves 41. The grooves 41 are arranged equidistantly in the axial direction so as to connect to the placement portions 23 of the rotational body 20, respectively. The grooves 41 are sized such that the containers 1 are contained therein.

The slider 40 is provided at the upstream end thereof with a plurality (ten in this embodiment) of arcuate recesses 42 that is created by the grooves 41. As described later, these recesses 42 function as receptacles for receiving the stem portions of the containers 1 that are rotated by the rotational body 20 at a certain angle, e.g., 90 degrees. When the recesses 42 receive the containers 1, the flanges of the received containers 1 are disengaged from the engagement portions 22; in this sense, the recesses 42 also function as a disengagement portion.

FIG. 7 is a perspective view depicting a conveying apparatus 50 for use in the container filling apparatus 100.

The conveying apparatus 50 is configured to convey the containers 1 with the contents 2 contained therein. For example, a conveyor having a rail 51 and a plurality of conveying plates 52 is used for the conveying apparatus 50. The plurality of conveying plates 52 are lined in the transport direction. The rail 51 is linked with, for example, a motor (not shown) and is configured to cause the conveying plates 52 to be moved in the transport direction. The conveying plates 52 are longer in the axial direction and include a plurality of receiving portions 53.

The plurality (ten in this embodiment) of receiving portions 53 is arrayed in the axial direction. The receiving portions 53 are holes provided in the feeding plate 11. The diameter of the receiving portions 53 is set larger than the diameter of the containers 1 in the state and slightly smaller than the diameter of a syringe. The depth of the receiving portions 53 is set larger than the height of the containers 1.

In the container filling apparatus 100 thus configured, the contents 2 are filled in the containers 1 in the following manner.

FIG. 8 is an explanatory view of a state in which the content 2 is fed by the first supply apparatus 10. FIG. 9 is an explanatory view of a state in which the content 2 is moved onto the rotational body 20. FIG. 10 is an explanatory view of a state in which the container 1 is placed over the content 2. FIGS. 11(*a*) to 11(*c*) are explanatory views of a state in which the flange of the container 1 is engaged with the engagement portions 22 on the rotational body 20. FIGS. 12 and 13 are explanatory views of a state in which the rotational body 20 with containers 1 placed thereon is being rotated. FIGS. 14 and 15 are explanatory views of a state in which the containers 1 are moving on the slider 40. FIG. 16 is an explanatory view of a state in which the containers 1 are contained in the conveying plates 52 of the conveying apparatus 50.

Since the process of filling the containers 1 with the contents 2 is performed continuously, it is to be noted that, in addition to the content 2 and the container 1 in the described process, contents 2 and containers 1 in processes preceding and following this process are depicted in the figures in some cases. More specifically, in FIGS. 9 and 10, the container 1 in the preceding process is depicted. In FIGS. 14 to 16, the containers 1 in the following process are depicted.

As depicted in FIGS. 1, 2, and 8, a plurality (ten in this embodiment) of contents 2 is arranged on each feed path 14. When the feeding bar 12 moves over the feeding plate 11, the contents 2 are moved toward the downstream side by being pushed by the feeding bar 12. When the contents 2 reach the downstream end of the feeding plate 11, the uppermost placement portions 23 become horizontal to be at the same height as the feeding plate 11. Thus, the feed paths 14 become continuous with the placement portions 23.

The feeding bar 12 moves past the downstream end of the feeding plate 11 to the upstream end of the placement portions 23. This causes the contents 2 to be placed from the feed paths 14 on the placement portion 23 that has become continuous with the feed paths 14. It is desired that the rotational body 20 intermittently rotates such that the placement portions 23 are kept still while the contents 2 are being fed from the feed paths 14 to the placement portions 23.

As depicted in FIG. 5(*a*), the suction units 32 suck the containers 1 while facing upward. The containers 1 are open at the upper side and are held by the suction units 32. Then, as depicted in FIG. 5(*b*), the base body 31 of the second supply apparatus 30 descends while the base body 31 is being rotated so as to render the suction units 32 to face downward. At this time, the containers 1 held by the suction units 32 are respectively positioned above the contents 2 placed on the placement portions 23. After that, as depicted in FIG. 10, the second supply apparatus 30 stops sucking operation when the containers 1 are placed over the contents 2.

Herein, as depicted in FIG. 11(*a*), each container 1 is placed from above each content 2 with the opening facing down. Thus, as depicted in FIG. 11(*b*), the content 2 gets in the container 1 from the opening. At this time, since the distance between the adjacent two wider portions is the same as or larger than the diameter of the flange at the upper side of the engagement portions 22, the flange fits in the space between the wider portions. As the flange approaches the placement portion 23, the distance between the trapezoidal wider portions becomes narrower so as to be the same as or smaller than the diameter of the flange. Thus, the flange shrinks along the inclination of the wider portions, and the diameter of the flange becomes smaller correspondingly to the distance between the wider portions. Hence, the flange approaches the placement portion 23 while the container 1 is deforming. Then, as depicted in FIG. 11(*c*), when the flange reaches the narrower portions, the shrunk flange spreads to the original size, for the distance between the narrower portions is the same as or larger than the diameter of the flange. This causes the flange to fit in between the placement portion 23 and the engagement portions 22, so as to halt the movement of the container 1 in the axial direction and in the direction perpendicular to the placement portion 23. Further, the container 1 becomes movable in the direction of rotation.

As depicted in FIG. 12, the rotational body 20 rotates, and the placement portions 23 begin to incline from a horizontal position to a vertical position. Thus, the slide-inducing force of the tilting placement portions 23 acts on the container 1. However, the centrifugal force due to rotation causes the flange to be hooked on the engagement portions 22, such that the container 1 is inclined without sliding off from the placement portion 23. Then, when the container 1 is rotated by the rotational body 20 at 90 degrees and the placement portions 23 become vertical, the outer surface of the container 1 hits a recess 42 in the upstream end of the slider 40. This causes the recess 42 to receive the stem portion of the container 1.

As depicted in FIG. 13, the rotational body 20 further rotates, and the seating is moved in the direction of rotation, while the movement of the container 1 in the direction of rotation is blocked by the recess 42. The container 1 however is movable in the direction of rotation. Hence, the container 1 shifts along the placement portion 23 with the flange got caught between the engagement portions 22 and the placement portion 23.

As depicted in FIG. 14, when the flange is released from the engagement portions 22 and the placement portion 23, the flange is disengaged from the engagement portions 22, such that the container 1 leaves from the placement portion 23.

As depicted in FIGS. 13 and 14, when the placement portion 23 starts to incline from the vertical position to face downward, the opening of the container 1 facing the placement portion 23 starts to incline so as to face upward. This causes the content 2 contained in the container 1 to move toward the bottom, and the container 1 becomes heavier at the bottom. Thus, when the flange is released from between the engagement portions 22 and the placement portion 23, the bottom of the container 1 descends until it hits the groove 41, such that the stem portion of the container 1 lies along the groove 41.

As depicted in FIG. 15, the container 1 slips down within the groove 41 with the heavier bottom at the lower side.

When the container 1 slips off from the groove 41, the container 1 fits from the bottom side thereof into the receiving portion 53 in the conveying plate 52. Since the diameter of the receiving portions 53 is smaller than the diameter of the flange, the flange is supported on the edge of the receiving portion 53, and the container 1 is held in the conveying plate 52. The container 1 in the conveying plate 52 is conveyed and transferred to, for example, a process of covering the opening with a lid.

With the above-described configuration, the containers 1 are rotated by the rotational shaft with the flanges being engaged with the engagement portions. Thus, the orientation of the containers 1 is changeable while the containers 1 are prevented from falling.

The recesses 42 block the movement of the containers 1 in the direction of rotation, thus causing the containers 1 to be displaced with respect to the placement portions 23, such that the flanges are released from the engagement portions 22. Hence, the operation for this engagement and disengagement by the engagement portions 22 is dispensed with. Thus, the structure of the container filling apparatus 100 is simplified and the size thereof is reduced.

Further, since the adjacent engagement portions 22 grip the flanges in the axial direction, the containers 1 are held on the rotational body 20 while being movable in the direction of rotation. Thus, the containers 1 being rotated by the rotational body 20 are easily pushed by the recesses 42 in the direction of rotation and toward the opposite side, such that the containers 1 are easily displaced from the placement portions 23 and the flanges become easily released from the engagement portions 22.

Since the receiving portions 53 of the conveying plates 52 are arranged below the grooves 41 of the slider 40, respectively, the containers 1 that have slipped off from the grooves 41 are received in the receiving portions 53. In this manner, the containers 1 are transferred without using power from the filling portion such as the rotational shaft to the conveying apparatus 50.

Further, since the recesses 42 at the upper portion of the slider 40 function as receptacles, the containers 1 received by the receptacles can slide down smoothly along the grooves 41 of the slider 40. In addition, since the recesses 42 are integrally provided with the grooves 41, the product cost is suppressed, and downsizing of the apparatus is achieved.

Moreover, the containers 1 slide down along the linear grooves 41, thus directing the containers such that the bottoms thereof come downward. Thus, when the containers 1 are moved below the grooves 41, the containers 1 are received smoothly from the bottom into the receiving portions 53 of the transport apparatus. Since the containers 1 that fit in the receiving portions 53 are open at the upper side, lids are easily attached to the openings of the containers 1.

While in the above-described embodiment, the truncated conical containers 1 are used, the containers may be, for example, cylindrical.

While in the above-described embodiment, the rotational body 20 with the four placement areas 21 is used, the number of placement areas 21 is not limited thereto. For example, the number of placement areas 21 to be provided on the rotational body 20 may be one or more than one. It is to be noted that the diameter of the rotational body 20 is desirably enlarged in proportion to an increase in number of placement areas 21.

While in the above-described embodiment, the octagonal columnar rotational body 20 is used, the shape of the rotational body 20 is not limited thereto. In the rotational body 20, the portions other than the placement portions may be either planar or curved.

While in the above-described embodiment, the placement portions 23 have a flat shape, the placement portions may take any shape insofar as the contents 2 are placeable thereon. For example, the placement portions may be recessed.

While in the above-described embodiment, the engagement portions 22 engage with the flanges of the containers 1. However, the containers 1 may be engaged with the engagement portions 22 at a position other than the flange.

While in the above-described embodiment, the conveyors are used for the first supply apparatus 10 and the transport apparatus, the apparatus to transport the contents 2 and the containers 1 is not limited thereto.

While in the above-described embodiment, the open edges of the grooves 41 on the slider 40 are used as receptacles. However, the receptacles and the slider 40 may be provided separately.

While in the above-described embodiment, bottomless apertures are used as the receiving portions 53 in the conveying plates 52, bottomed recesses may be used as the receiving portions 53.

In the foregoing embodiments, "horizontal" and "vertical" include approximately horizontal and approximately vertical, respectively.

Numerous improvements and other embodiments of the present invention are apparent to those skilled in the art from the foregoing description. Hence, the foregoing description should be interpreted as examples and is presented for the purpose of teaching those skilled in the art the best mode for carrying out the present invention. The details of structures and/or functions are substantially changeable without departing from the spirit of the present invention.

INDUSTRIAL APPLICABILITY

The container filling apparatus 100 according to the present invention is useful as, for example, a container filling apparatus 100 with a simpler structure and a smaller size.

REFERENCE SIGNS LIST

1 Container
2 Content
10 First supply apparatus
11 Feeding plate
20 Rotational body
22 Engagement portion
23 Placement portion
30 Second supply apparatus
40 Slider
41 Groove
42 Recess (Receptacle)
50 Conveying apparatus
53 Receiving portion
100 Container filling apparatus

The invention claimed is:

1. A container filling apparatus comprising:

a first supply apparatus configured to supply a content;

a rotational body having a placement portion configured to carry the content supplied by the first supply apparatus, the rotational body being configured to rotate with respect to an axis thereof to turn the placement portion;

a second supply apparatus configured to place a container from above the content placed in an upward-facing state on the placement portion;

an engagement portion provided on the rotational body and configured to engage with the container that is placed over the content by the second supply apparatus; and a disengagement portion configured to block movement of the container when rotated by the rotational body, wherein the container is disengageable from the engagement portion when a rotational movement of the container about the axis is blocked by the disengagement portion.

2. The container filling apparatus according to claim 1, further comprising:

a slider having a downward-slanting groove configured to let the container disengaged from the engagement portion slide off; and a conveying apparatus having a receiving portion configured to receive the container slid off from the groove.

3. The container filling apparatus according to claim 1, wherein a plurality of engagement portions identical to the engagement portion is provided in a direction of the axis of the rotational body, and the placement portion is arranged in between the plurality of engagement portions.

4. The container filling apparatus according to claim 1, further comprising a receptacle configured to receive a stem portion of the container, the receptacle being configured to disengage the received container from the engagement portion.

5. The container filling apparatus according to claim 1, wherein the rotational body has four placement portions identical to the placement portion in a direction of the rotation, and the disengagement portion is configured to receive a stem portion of the container that is rotated by the rotational body at 90 degrees.

* * * * *